US006824938B2

(12) United States Patent
Kizaki et al.

(10) Patent No.: US 6,824,938 B2
(45) Date of Patent: Nov. 30, 2004

(54) ELECTROPHOTOGRAPHIC PHOTORECEPTOR

(75) Inventors: Hiroe Kizaki, Yokohama (JP); Mamoru Nozomi, Yokohama (JP); Tetsuo Ozawa, Yokohama (JP); Kozo Ishio, Yokohama (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 10/196,185

(22) Filed: Jul. 17, 2002

(65) Prior Publication Data

US 2003/0096180 A1 May 22, 2003

(30) Foreign Application Priority Data

Jul. 18, 2001 (JP) ..... 2001-217681

(51) Int. Cl.[7] ..... G03G 5/14
(52) U.S. Cl. ..... 430/60; 430/131; 399/159
(58) Field of Search ..... 430/65, 63, 131, 430/60, 64; 359/49; 399/159

(56) References Cited

U.S. PATENT DOCUMENTS

| | | | | | |
|---|---|---|---|---|---|
| 4,106,935 | A | * | 8/1978 | Petruzzella | 430/64 |
| 4,664,997 | A | | 5/1987 | Suzuki et al. | |
| 5,306,586 | A | * | 4/1994 | Pai et al. | 430/58.5 |
| 5,403,686 | A | | 4/1995 | Bugner et al. | |
| 5,477,312 | A | | 12/1995 | Hori | |
| 5,800,956 | A | * | 9/1998 | Minemura et al. | 430/60 |
| 6,214,506 | B1 | | 4/2001 | Kurihara et al. | |
| 2002/0018660 | A1 | * | 2/2002 | Sato | 399/49 |
| 2002/0098005 | A1 | * | 7/2002 | Takeuchi et al. | 399/49 |
| 2002/0119383 | A1 | * | 8/2002 | Yahagi et al. | 430/69 |

FOREIGN PATENT DOCUMENTS

| | | | | |
|---|---|---|---|---|
| JP | 52-25638 | | 2/1977 | |
| JP | 56-21129 | | 2/1981 | |
| JP | 60-225854 | | 11/1985 | |
| JP | 63-165864 | | 7/1988 | |
| JP | 2-82263 | | 3/1990 | |
| JP | 3-33858 | | 2/1991 | |
| JP | 3-62039 | | 3/1991 | |
| JP | 4-31870 | | 2/1992 | |
| JP | 06118665 | A * | 4/1994 | G03G/5/05 |
| JP | 7-36230 | | 2/1995 | |
| JP | 7-160028 | | 6/1995 | |
| JP | 2000-105480 | | 4/2000 | |
| JP | 2000-119276 | | 4/2000 | |
| JP | 2000-199977 | | 7/2000 | |

OTHER PUBLICATIONS

Borsenberger, Paul M. et al. Organic Photoreceptors for Imaging Systems. New York: Marcel–Dekker, Inc. (1993) pp. 6–17.*

* cited by examiner

*Primary Examiner*—Christopher Rodee
(74) *Attorney, Agent, or Firm*—Oblon, Spivak, McClelland, Maier & Neustadt, P.C.

(57) ABSTRACT

An electrophotographic photoreceptor having at least an undercoat layer and a photosensitive layer on an electroconductive substrate, wherein at least one layer of the undercoat layer contains a naphthalocyanine compound of the following formula (1):

(1)

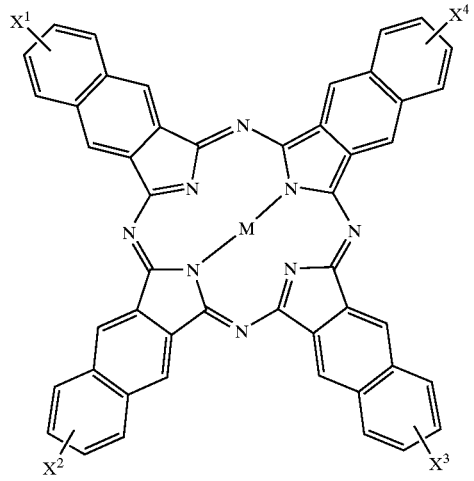

where, in the formula (1), M represents two hydrogen atoms, or a metal atom, provided that the metal atom may have a ligand, and each of $X^1$, $X^2$, $X^3$ and $X^4$ is a hydrogen atom or a substituent.

19 Claims, No Drawings

ELECTROPHOTOGRAPHIC PHOTORECEPTOR

The present invention relates to an electrophotographic photoreceptor. Particularly, it relates to an electrophotographic photoreceptor which is capable of controlling the infrared reflectance of the photoreceptor by preventing interference fringes without impairing the electrophotographic properties.

Heretofore, for electrophotographic photoreceptors, an inorganic photoconductive material such as selenium, a selenium-tellurium alloy, arsenic selenide or cadmium sulfide, has been widely employed. On the other hand, in recent years, there have been active researches on photosensitive layers employing organic photoconductive materials which can easily be produced. Particularly, function-separated laminated photoreceptors comprising a charge generation layer having a function to generate electric charge upon absorption of light and a charge transport layer having a function to transport the generated electric charge, have become most common. Such photoreceptors are widely used in the fields of copying machines, laser printers, etc.

Electrophotographic photoreceptors have a basic structure such that a photosensitive layer is formed on an electroconductive substrate. It is common to provide an undercoat layer between the photosensitive layer and the substrate in order to solve a problem of image defects due to defects of the substrate or due to injection of electric charge from the substrate, or to improve the electrification properties or the adhesion with the photosensitive layer. Heretofore, it has been known to use, for the undercoat layer, a resin material such as a polyamide resin, a polyester resin, a polyurethane resin, a polycarbonate resin, an epoxy resin, a polyurethane resin, a vinyl chloride resin, an acrylic resin, a phenol resin, a urea resin, a melamine resin, a guanamine resin, a polyvinyl alcohol, casein or gelatin. Among these resin materials, a solvent-soluble polyamide resin is particularly preferred (JP-A-52-25638, JP-A-56-21129, and JP-A-4-31870).

In recent years, along with the trend of digitization, electrophotographic apparatus have become mainly of digital system. Among electrophotographic apparatus of digital system, those employing semiconductor lasers to form images, are required to suppress image defects by interference patterns. As one of methods to avoid interference fringes, it is known to roughen the surface of a substrate (electroconductive substrate) by rough cutting, sand blasting or the like (e.g. JP-A-60-225854, JP-A-3-62039). However, such a method has a problem that the degree of roughening of the substrate can hardly be precisely reproduced, and there will be a variation in the effect for reducing interference fringes, among production lots. Further, along with the progress in high resolution of the apparatus in recent years, at a resolution of 1,200 dpi (dots per inch), there will be a case where no adequate effect for reducing interference fringes is obtainable only by roughening of the substrate. Further, as described hereinafter, in a case where the obtained photoreceptor is used for an electrophotographic apparatus employing an optical toner density sensor, there may be a case where the surface roughness of the substrate adversely affects the detection of the toner density.

On the other hand, a method is also proposed wherein a near infrared absorbing dye is incorporated in the photosensitive layer or in the undercoat layer (e.g. JP-A-63-165864, JP-A-2-82263, JP-A-3-33858, JP-A-7-160028 (U.S. Pat. No. 5,403,686, EP 0645680), JP-A-2000-105480, JP-A-2000-199977). However, there has been an adverse effect to the electrical properties of the photoreceptor, particularly it has been difficult to obtain a photoreceptor having a high sensitivity, and no adequate effect has been obtained due to deterioration by light, etc.

Further, a method has been proposed in which coarse particles are incorporated to the undercoat layer to increase scattered light in the undercoat layer thereby to reduce interference fringes. However, in order to obtain an adequate effect to prevent interference fringes solely by this method, the thickness of the undercoat layer is required to be thick, a step of curing such an undercoat layer will accordingly be required, whereby there will be a problem that the production process will be complex, and the production cost increases.

Further, in recent years, many image-forming apparatus of electrophotographic system are designed to obtain a constant image by carrying out an image density control in such a manner that in order to correct deviations of various conditions due to a change of environment of their use, deterioration of the photoreceptor or developing material, etc., toner patches for detecting densities are formed on the photoreceptor, and their densities are detected by an optical density sensor, so that from the detected results, feedback is applied to the light exposure, the development bias, etc. to control the image density (JP-A-7-36230 (U.S. Pat. No. 5,477,312), etc.). Further, especially with a color image-forming apparatus, it is known that the measuring precision can be improved by measuring the diffuse reflection component of the toner patches (JP-A-2000-105480).

Under these circumstances, with the above-mentioned photoreceptor having the substrate surface of the photoreceptor roughened to reduce interference fringes, it is difficult to obtain such a photoreceptor having constant reflection properties, since the diffuse reflection of the substrate roughness is substantial, and due to variation in the process of roughening the photoreceptor substrate, for example, due to variation in the cutting tool state during the rough cutting or in the reproducibility of the cutting feed pitch, the reflection characteristics of the resulting substrate will vary. Further, the diffuse reflection of the substrate surface of the photoreceptor is high, and when the image density control is carried out by a diffuse reflection density sensor, no adequate S/N ratio to the diffuse reflection of the toner patches can be obtained, whereby accurate control of the image density tends to be hardly possible.

Further, with a photoreceptor wherein coarse particles are incorporated to the undercoat layer to increase scattered light in the undercoat layer thereby to prevent interference fringes, the irradiated light from the toner density sensor transmitted through and scattered by the toner patches, will be further scattered by the undercoat layer and will thereby adversely affect the detection of the toner density. Thus, no adequate effect to prevent interference fringes can be obtained in electrophotography of a high resolution of a level of 1,200 dpi, solely by surface roughening of the substrate of the photoreceptor. In the above-mentioned toner density sensor measuring only the diffuse reflection component, the above-mentioned surface roughness of the substrate influences substantially over the infrared light reflectance of the photoreceptor. In a case where the substrate surface is roughened to prevent interference fringes, the infrared reflectance of the photoreceptor varies depending upon the individual difference in the surface roughness, whereby accurate control of the image density can hardly be carried out. Further, the diffuse reflection of the substrate surface of the photoreceptor is essentially high, whereby an adequate S/N (signal to noise) ratio can hardly be secured for detecting the toner density.

Further, especially when scattering in the undercoat layer is utilized to prevent interference fringes, the irradiated light from the sensor transmitted through and scattered by the toner patches will be detected as further scattered by the undercoat layer, whereby there will be problem that the detected level is higher than the actual toner density.

Under these circumstances, it is an object of the present invention to provide an electrophotographic photoreceptor which is capable of preventing interference fringes without impairing electrophotographic properties and which is capable of controlling the infrared reflectance of the photoreceptor and capable of improving the detection accuracy of an optical density sensor, and an electrophotographic apparatus employing such an electrophotographic photoreceptor.

Under these circumstances, the present inventors have conducted an extensive study on the material for the undercoat layer capable of satisfying the above required properties and as a result, have found it possible to accomplish the above object by incorporating a certain specific naphthalocyanine compound.

Namely, the present invention provides an electrophotographic photoreceptor having at least an undercoat layer and a photosensitive layer on an electroconductive substrate, wherein at least one layer of the undercoat layer contains a naphthalocyanine compound of the following formula (1):

(1)

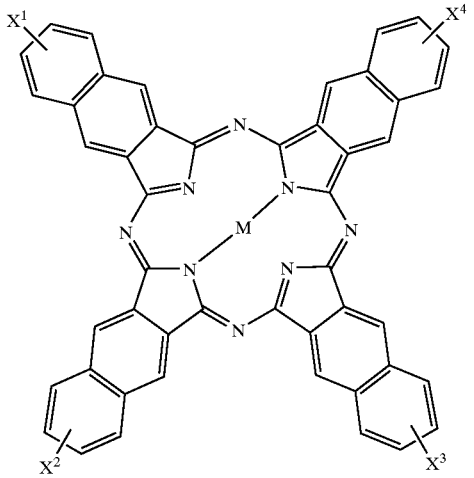

where, in the formula (1), M represents two hydrogen atoms, or a metal atom, provided that the metal atom may have a ligand, and each of $X^1$, $X^2$, $X^3$ and $X^4$ is a hydrogen atom or a substituent.

Further, the present invention provides an electrophotographic apparatus comprising a means to use the above-mentioned electrophotographic photoreceptor and to form a toner image for measuring the density, on the electrophotographic photoreceptor, and a means to measure the density of the toner image by an optical density sensor comprising a light-emitting section for emitting light in a near infrared region and a light-receiving section.

Now, the present invention will be described in detail with reference to the referred embodiments.

Electroconductive Substrate

As the electroconductive substrate, a metal material such as aluminum, an aluminum alloy, stainless steel, copper or nickel, a resin material having electrical conductivity imparted by an addition of an electroconductive powder of e.g. a metal, carbon or tin oxide, or a resin, glass or paper having an electroconductive material such as aluminum, nickel or ITO (an indium oxide/tin oxide alloy) vapor-deposited or coated on its surface, is mainly employed. As to the shape, one of drum-shape, seat-shape or belt-shape, may, for example, be employed. It may further be one having an electroconductive material having a proper resistance coated on the electroconductive support made of metal material, in order to cover defects or to control the electroconductivity or the surface properties.

In a case where a metal material such as an aluminum alloy is to be used for the electroconductive substrate, it may be employed after applying e.g. anodic oxidation or caustic passivation treatment. In a case where anodic oxidation treatment is applied, it is preferred to apply sealing treatment by a known method.

The surface of the substrate may be smooth or may be roughened by using a special cutting method or by applying polishing treatment. Further, it may be one surface-roughened by incorporating particles having a proper particle size to a material constituting the substrate. In the present invention, the surface roughness of the electroconductive substrate is preferably $Ry \leqq 1.0$ $\mu$m in order to improve the accuracy in detection by an optical toner density sensor. Especially when it is used in combination with a toner density sensor for measuring the diffuse reflection, the surface of the electroconductive substrate is preferably not roughened, and accordingly, the surface roughness is more preferably $Ry \leqq 0.5$ $\mu$m. Further, one having made to have a surface roughness of $Ry \leqq 0.3$ $\mu$m by e.g. specular surface cutting, is more preferred. Here, Ry represents the maximum height of the profile curve prescribed in JIS (Japanese Industrial Standards) B-0601, 1994 (the sum of the maximum height of mountain and the maximum depth of valley).

Undercoat Layer

The electrophotographic photoreceptor of the present invention is one wherein an undercoat layer containing a naphthalocyanine compound of the following formula (1) is formed between the electroconductive substrate and a photosensitive layer. The undercoat layer may be divided into two or more layers. In a case where the undercoat layer is divided into two or more layers, the naphthalocyanine compound of the following formula (1) is contained in at least one of the divided undercoat layers.

(1)

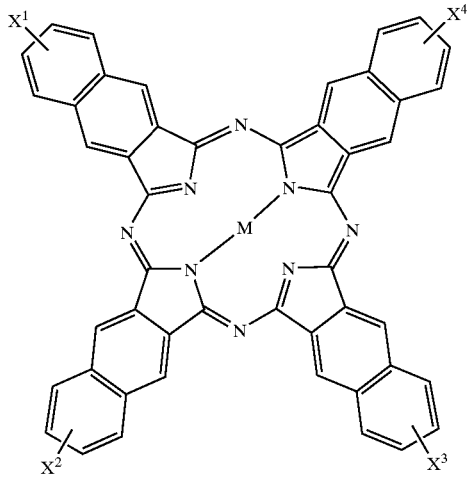

In the formula (1), M represents two hydrogen atoms, or a metal atom, provided that the metal atom may have a ligand. M is preferably a metal atom, particularly preferably a bivalent or higher valent metal atom. As the center metal represented by M, Sn, Cu, CO, Ni, Fe, Zn, Ti, V, Al, Ga, In, Si, Ge, Sn or Pb may, for example, be mentioned.

As the ligand of the center metal, an oxygen atom, a sulfur atom, a halogen atom such as a chlorine atom or a bromine atom, a hydroxyl group, an alkoxy group such as a methoxy group or an ethoxy group, or an alkylthio group such as a methylthio group or an ethylthio group, may, for example, be mentioned. Each of $X^1$, $X^2$, $X^3$ and $X^4$ is a hydrogen atom or a substituent. The substituent may, for example, be a halogen atom, an alkyl group having at most 8 carbon atoms, an alkoxy group having at most 8 carbon atoms, or an aryloxy group. Among them, a hydrogen atom, an alkyl group having at most 8 carbon atoms, such as a methyl group, an ethyl group, a n-propyl group, an i-propyl group or a t-butyl group, or a halogen atom such as chlorine or bromine, is preferred, and a hydrogen atom is particularly preferred.

A particularly preferred naphthalocyanine compound may, for example, be dichlorotin naphthalocyanine (hereinafter referred to simply as $SnCl_2NPc$) wherein the center metal atom represented by M is tin, the ligand is chlorine, and each of $X^1$, $X^2$, $X^3$ and $X^4$ is a hydrogen atom. $SnCl_2NPc$ can also be obtained by reacting dicyanonaphthalocyanine with tin chloride in an organic solvent such as chloronaphthalene, in accordance with a prescribed method.

With respect to the content of the naphthalocyanine compound in the undercoat layer, it is incorporated in a concentration suitable for the control of the image density by the diffuse reflection density sensor. If it is too small, the effect to reduce interference fringes of an image tends to be small, and if it is too large, the surface potential after exposure tends to increase, such being undesirable. The content of the phthalocyanine compound is usually at least 0.001 part by weight, preferably at least 0.005 part by weight, per 100 parts by weight of the binder resin, and usually at most 100 parts by weight, preferably at most 10 parts by weight, most preferably at most 5 parts by weight, per 100 parts by weight of the binder resin.

Further, as the undercoat layer, one having particles of e.g. a metal oxide dispersed in a resin, is usually employed. The particles of a metal oxide to be used for the undercoat layer, may, for example, be particles of a metal oxide containing one type of metal element, such as titanium oxide, aluminum oxide, silicon oxide, zirconium oxide, zinc oxide or iron oxide, or particles of a metal oxide containing a plurality of metal elements, such as calcium titanate, strontium titanate or barium titanate. Particles of one type only may be employed, or particles of plural types may be used as mixed. Among such metal oxide particles, titanium oxide particles and aluminum oxide particles are preferred, and particularly preferred are titanium oxide particles. The titanium oxide particles may have the surface treated with an organic substance such as tin oxide, aluminum oxide, antimony oxide, zirconium oxide or silicon oxide, or with an organic substance such as stearic acid, a polyol or silicone. The crystal form of the titanium oxide particles may be any of rutile, anatase, brookite and amorphous. Those in a plurality of crystal states may be contained.

Further, with respect to the particle sizes of the metal oxide particles, those having various sizes may be employed. However, from the viewpoint of the properties and the stability of the liquid, the average primary particle size is preferably from 10 to 100 nm, particularly preferably from 10 to 50 nm.

The undercoat layer is preferably formed so that metal oxide particles are dispersed in a binder resin. As the binder resin to be used for the undercoat layer, phenoxy, epoxy, polyvinyl pyrrolidone, polyvinyl alcohol, casein, polyacrylic acid, celluloses, gelatin, starch, polyurethane, polyimide or polyamide may, for example, be used alone or in a form cured together with a curing agent. Among them, an alcohol soluble copolymer polyamide or a modified polyamide is, for example, preferred, since it exhibits good dispersibility and coating property.

The ratio of the inorganic particles to the binder resin may optionally be selected, but the inorganic particles are preferably used within a range of from 10 to 500 wt %, from the viewpoint of the stability and coating property of the dispersion.

The thickness of the undercoat layer and the number of layers therein, may optionally be selected. However, usually, one layer is formed between the electroconductive substrate and the photosensitive layer. If the thickness is too thin, no adequate blocking performance can be obtained, and a black point of image tends to form. On the other hand, if the layer thickness is made thick, the residual potential of the photoreceptor tends to increase. Further, if the layer thickness is made thick, coating defects or non-uniformity in the layer thickness are likely to result, and to prevent such results, the binder is required to be used in a cured form. To use the binder in a cured form makes the production process cumbersome, and there is a problem that the stability of the coating fluid will deteriorate. Accordingly, from the viewpoint of the photoreceptor properties and the productivity, the thickness of the undercoat layer is preferably at least 0.1 $\mu$m, more preferably at least 0.5 $\mu$m. Further, it is preferably at most 20 $\mu$m, more preferably at most 10 $\mu$m.

To the undercoat layer, coarse particles may be added in order to control the effect to reduce interference fringes and/or the reflectance of the photoreceptor. As the type of the coarse particles, silica, silicone, Teflon, polystyrene, etc., may be mentioned. The particle size of such coarse particles is not particularly limited. From the viewpoint of reducing interference fringes, the larger the particle size, the higher the effect. However, if the particle size is too large, coarse particles tend to settle in the coating fluid, whereby the stability of the coating fluid tends to be impaired. Accordingly, the particle size is preferably from 0.05 to 1 $\mu$m, more preferably from 0.1 to 0.5 $\mu$m.

Further, known antioxidant, leveling agent, etc. may be added to the undercoat layer.

Photosensitive Layer (1) Layer Structure as a Specific Construction of the Photosensitive Layer As examples of the basic constructions, the following photoreceptors may be mentioned:

A laminated type photoreceptor wherein a charge generation layer containing a charge generation material as the main component, and a charge transport layer containing a charge transport material and a binder resin as the main components, are laminated in this order on an electroconductive substrate.

A reversed double layer type photoreceptor wherein a charge transport layer containing a charge transport material and a binder resin as the main components, and a charge generation layer containing a charge generation material as the main component, are laminated in this order on an electroconductive substrate.

A single layer type (dispersion type) photoreceptor wherein a layer containing a charge transport material and a binder resin, is laminated on an electroconductive substrate, and in that layer, a charge generation material is dispersed.

(2) Charge Generation Material

As charge generation materials, various photoconductive materials may be used including inorganic photoconductive materials such as selenium and its alloys, cadmium sulfide, etc., and organic pigments such as a phthalocyanine pigment, an azo pigment, a quinacridone pigment, an indigo pigment, a perylene pigment, a polycyclic quinone pigment, an anthrathrone pigment and a benzimidazole pigment. Particularly, organic pigments are preferred, and more particularly, a phthalocyanine pigment and an azo pigment are preferred.

Among them, non-metallic phthalocyanine, a phthalocyanine having a metal such as copper, indium, potassium, tin, titanium, zinc or vanadium, or its oxide or chloride, coordinated, or an azo pigment such as monoazo, a bisazo, a trisazo or a polyazo, is particularly preferred.

When a phthalocyanine compound is employed as the charge generation material, it may specifically be non-metal phthalocyanine or a phthalocyanine having a metal such as copper, indium, gallium, tin, titanium, zinc, vanadium, silicon or germanium, or its oxide or halide, coordinated thereto. The ligand to the trivalent or higher valent metal atom may, for example, be a hydroxyl group or an alkoxy group in addition to the above-mentioned oxygen atom or chlorine atom. Particularly preferred is highly sensitive X-type or τ-type non-metal phthalocyanine, titanyl phthalocyanine of α-type, β-type or Y-type, vanadyl phthalocyanine, chloroindium phthalocyanine, chlorogallium phthalocyanine or hydroxygallium phthalocyanine. Among the crystal forms of titanyl phthalocyanine mentioned above, the α-type and the β-type are identified as II-phase and I-phase, respectively, by W. Heller et al (Zeit, Kristallogr. 159 (1982) 173), and the β-type is one known as a stabilized type. The Y-type which is most preferably employed, is of a crystal form characterized by showing a distinct peak at a diffraction angle 2θ±0.2° of 27.3° in the powder X-ray diffraction using CuKα ray. The phthalocyanine compounds may be used alone or in combination as a mixture of two or more of them. Here, a mixture of phthalocyanine compounds or crystal forms, may be prepared by mixing the respective constituting elements later, or the mixed state may be formed in the process for production or treatment of phthalocyanine compounds, such as synthesis, pigmentation or crystallization. As such treatment, acid paste treatment, pulverization treatment or solvent treatment is, for example, known.

(3) Charge Transport Material

The charge transport material may, for example, be an electron attractive material, such as an aromatic nitro compound such as 2,4,7-trinitrofluorenone, a cyano compound such as tetracyanoquinodimethane, or a quinone such as diphenoquinone, or an electro donative material, such as a heterocyclic compound such as a carbazole derivative, an indole derivative, an imidazole derivative, an oxazole derivative, a pyrazole derivative, an oxadiazole derivative, a pyrazoline derivative or a thiadiazole derivative, an aniline derivative, a hydrazone compound, an aromatic amine derivative, a stilbene derivative, a butadiene derivative, an enamine compound, or one having a plurality of these compounds bonded, or a polymer having groups made of such compounds, in the main chain or side chains. Among them, particularly preferred is a carbazole derivative, a hydrazone derivative, an aromatic amine derivative, a stilbene derivative, a butadiene derivative, or one having a plurality of these derivatives bonded.

These charge transport materials may be used alone or in combination as a mixture of two or more of them. The charge transport layer is formed in a form wherein such a charge transport material is bonded to a binder resin. The charge transport layer may be made of a single layer or a laminate having a plurality of layers different in the constituting components or in the compositional ratios laminated one on another.

The content of the charge transport material in the charge transport layer or the photosensitive layer is usually at most 45 wt %, preferably at most 40 wt %, more preferably at most 35 wt %, particularly preferably at most 30 wt %, in the charge transport layer, from the viewpoint of durability.

(4) Laminated Type Photosensitive Layer

① Charge Generation Layer

In the case of a laminated type photoreceptor, the above-described charge generation material is used in a form bonded to various binder resins, such as a polyester resin, a polyvinyl acetate, a polyacrylate, a polymethacrylate, a polycarbonate, a polyvinyl acetoacetal, a polyvinyl propional, a polyvinyl butyral, a phenoxy resin, an epoxy resin, a urethane resin, a cellulose ester and a cellulose ether. In such a case, the ratio of the charge generation material is usually within a range of from 20 to 2,000 parts by weight, preferably from 30 to 500 parts by weight, more preferably from 33 to 500 parts by weight, per 100 parts by weight of the binder resin. Further, it may contain other organic photoconductive compounds, dyes, pigments or electron attractive compounds, as the case requires. The thickness of the charge generation layer is usually from 0.05 to 5 μm, preferably from 0.1 to 2 μm, more preferably from 0.15 to 0.8 μm.

② Charge Transport Layer

The charge transport layer comprises the charge transport material and the binder resin, as the main components. The binder resin may, for example, be a thermoplastic resin such as a polycarbonate, a polyester, a polysulfone, a phenoxy, an epoxy or a silicone rein, or various thermosetting resins. Among these resins, it is preferred to employ a polycarbonate resin or a polyester resin from the viewpoint of the electrical properties and mechanical properties.

The ratio of the charge transport material to the binder resin is usually such that the charge transport material is used usually from 30 to 200 parts by weight, preferably from 40 to 150 parts by weight, most preferably at most 90 parts by weight, per 100 parts by weight of the binder resin, such being advantageous with a view to maintaining the mechanical properties. Further, the thickness is usually from 10 to 60 μm, preferably from 10 to 45 μm.

To the charge transport layer, well known additives such as a plasticizer, an antioxidant, an ultraviolet absorber, an electron attractive compound, a leveling agent and a sensitizing agent, may be incorporated to improve e.g. the film-forming property, flexibility, coating property, antifouling property, gas resistance, light resistance, etc. The antioxidant may, for example, be a hindered phenol compound or a hindered amine compound.

(5) Single Layer Type Photoreceptor

In the case of the single layer type photoreceptor, the charge generation material similar to the one for the laminated type photoreceptor and the above-described charge transport material, are dispersed in the charge transport medium composed mainly of the above-described binder resin. The particle size of the charge generation material in such a case is required to be sufficiently small, and it is preferably at most 1 μm, more preferably at most 0.5 μm. If the amount of the charge generation material dispersed in the photosensitive layer is too small, no adequate sensitivity can be obtained, and if it is too much, a trouble such as a decrease in the electrification or a decrease in the sensitivity, is likely to result. Accordingly, it is used preferably within a range of from 0.5 to 50 wt %, more preferably within a range of from 1 to 20 wt %.

The thickness of the photosensitive layer is usually from 5 to 50 μm, preferably from 10 to 45 μm. Also in such a case, a known plasticizer to improve the film forming property, flexibility and mechanical strength, an additive to suppress the residual potential, a dispersion assistant to improve the dispersion stability, a leveling agent, a surfactant or other additive such as silicone oil or fluorine type oil, to improve the coating property, may be incorporated.

(6) Other Additives

The dye or colorant to be added to the photosensitive layer as the case requires, may, for example, be a triphenylmethane dye such as methyl violet, brilliant green or crystal violet, a thiazine dye such as methylene blue, a quinone dye such as quinizarin, a cyanine dye, bilirium salt, a thiabilirium salt, or a benzobilirium salt.

Further, the electron attractive compound may, for example, be a quinone such as chloranil, 2,3-dichloro-1,4-naphthoquinone, 1-nitroanthraquinone, 1-chloro-5-nitroanthraquinone, 2-chloroanthraquinone or phenanthrenequinone; an aldehyde such as 4-nitrobenzaldehyde; a ketone such as 9-benzoylanthracene, indandione, 3,5-dinitrobenzophenone, 2,4,7-trinitrofluorenone, 2,4,5,7-tetranitrofluorenone or 3,3',5,5'-tetranitrobenzophenone; an acid anhydride such as phthalic anhydride or 4-chloronaphthalic anhydride; a cyano compound such as tetracyanoethylene, terephthalal malononitrile, 9-anthrylmethylidene malononitrile, 4-nitrobenzal malononitrile or 4-(p-nitrobenzoyloxy)benzalmalononitrile; or a phthalide such as 3-benzalphthalide, 3-(α-cyano-p-nitrobenzal)phthalide or 3-(α-cyano-p-nitrobenzal)-4,5,6,7-tetrachlorophthalide.

Other Protective Layers

On the photosensitive layer, a protective layer may be provided for the purpose of preventing abrasion of the photosensitive layer or preventing or reducing the deterioration of the photosensitive layer by a discharge product, etc., generated from the charging device or the like.

Further, the surface layer may contain a fluorine resin, a silicone resin or the like, for the purpose of reducing the friction or the frictional resistance of the surface of the photoreceptor. Otherwise, it may contain particles made of such a resin or particles of an inorganic compound.

Still further, an interlayer such as a barrier layer, an adhesive layer or a blocking layer, or a layer to improve the electrical properties or mechanical properties, such as a transparent insulating layer, may be provided, as the case requires.

Method for Forming Each Layer

The method for coating each layer may, for example, be a spray coating method, a spiral coating method, a ring coating method or a dip coating method. The spray coating method may, for example, be air spraying, airless spraying, electrostatic air spraying, electrostatic airless spraying, rotational atomizing electrostatic spraying, hot spraying or hot airless spraying. Taking into consideration fine granularity, adhesive efficiency, etc. to obtain a uniform layer thickness, it is preferred to employ rotational atomizing electrostatic spraying, in which the transporting method as disclosed in JP-A-1-805198 i.e. continuous transportation without an interval in its axial direction while rotating a cylindrical work, is employed, whereby an electrophotographic photoreceptor excellent in the uniformity of the layer thickness, can be obtained at overall high deposition efficiency.

The spiral coating method may, for example, be a method of employing a liquid-injection coating machine or a curtain coating machine as disclosed in JP-A-52-119651, a method of continuously jetting the coating material in streaks from fine openings, as disclosed in JP-A-1-231966, or a method of using multi nozzles as disclosed in JP-A-3-193161.

Now, an example of forming a photosensitive layer by a dip coating method will be described.

Using a charge transport material (preferably the above-mentioned compound), a polyarylate resin, a solvent, etc., a coating fluid for forming a charge transport layer having a total solid content concentration of usually from 25 to 40% and a viscosity of usually from 50 to 300 centipoise, preferably from 100 to 200 centipoise, is prepared. Here, the viscosity of the coating fluid is substantially determined by the type of the binder polymer and its molecular weight. In a case where the molecular weight is too low, the mechanical strength of the polymer itself deteriorates. Accordingly, it is preferred to use a binder polymer having a molecular weight of a level not to impair the mechanical strength. Using the coating fluid thus prepared, a charge transport layer is formed by a dip coating method.

Then, the coated layer is dried, and the drying temperature and time are adjusted so that the necessary and adequate drying can be carried out. The drying temperature is usually within a range of from 100 to 250° C., preferably from 110 to 170° C., more preferably from 120 to 140° C. As the drying means, a hot air dryer, a steam dryer, an infrared dryer or a far infrared dryer may, for example, be employed. The electrophotographic photoreceptor thus obtained is highly sensitive and has a low residual potential and a high electrostatic property, and changes in such properties by repetition are small. Especially, charge stability influential over the image density is good, whereby it can be used as a photoreceptor having high durability. Further, the sensitivity in a region of from 750 to 850 nm is high, whereby it is particularly suitable for a photoreceptor for a semiconductor laser printer.

Electrophotographic Apparatus

An electrophotographic apparatus such as a copying machine or a printer employing the electrophotographic photoreceptor of the present invention, includes at least electrification, exposure, development and transfer processes. The respective processes can be carried out by conventional methods. For the electrification (electrical charging device), for example, corotoron or scorotoron electrification utilizing corona discharge, or contact electrification by means of a conductive roller, brush or film, may be employed. As an electrification method employing corona discharge, scorotoron electrification is used in many cases in order to maintain dark potential to be constant. As a developing method, it is common to employ a method of developing by contacting or not-contacting a magnetic or non-magnetic one-component developer or two-component developer. As a transfer method, a method employing corona discharge, or a method employing a transfer roller or a transfer belt, may be employed. The transfer may be carried out directly on paper or OHP film, or may be carried out once on an intermediate transfer means (belt-type or drum-type) and then on paper or OHP film.

Usually, a fixing process for fixing the developer to paper is employed after the transfer. As the fixing means, sheet fixing or pressure fixing which is commonly employed, may be used. In addition to these processes, a process which is commonly employed, such as cleaning or antistatic process, may be included.

Further, to obtain a stabilized image, it is effective to provide an image density controlling function such that in order to correct deviations of various conditions due to a change of the environment, deterioration of the photoreceptor or the developing material, several toner patches differing in the exposure and the development bias, are prepared on the photoreceptor, and their densities are detected by an optical density sensor, and from the detected results, feedback is applied to the exposure and the development bias.

As the measuring system of the optical density sensor, it is possible to use either a system wherein the photoreceptor is irradiated with a light source, and the regular reflection light intensity is measured, or a system wherein the diffuse reflection intensity is measured. In the case of measuring the regular reflection, it is common to apply a light source for irradiation substantially perpendicularly to the photoreceptor surface and to carry out detection by a detector provided together with the light source. In a case where the diffuse reflection is measured, there is no particular restriction as to the positional relation of the detector and the light source, so long as diffuse light can be measured, but a method may, for example, be mentioned wherein a light source is applied for irradiation at an angle of 45° to the photoreceptor surface, and the component diffuse-reflected in a direction perpendicular to the photoreceptor surface, is detected. Especially when a color toner is used, an accurate density measurement is possible by the method of measuring diffuse reflection. A more accurate density measurement is possible, if the regular reflection system, and the diffuse reflection system are used in combination.

As the light source for the optical density sensor, it is preferred to have a wavelength not to adversely affect the photoreceptor and not to give an influence such as a change in the layer thickness of the photoreceptor, scratches on the surface, etc. Accordingly, near infrared light, such as LED (light emitting diodes) in the vicinity of from 800 to 1,000 nm, is suitable. As the detector, photodiode is preferred.

Now, specific embodiments of the present invention will be described in further detail with reference to Examples. However, it should be understood that the present invention is not limited by such Examples. Further, "parts" used in Examples indicates "parts by weight" unless otherwise specified.

PREPARATION EXAMPLE 13.5 g of 2,3-naphthalene dicarboxylic anhydride, 13.5 g of urea, 6.4 g of tin (II) chloride, 0.5 g of ammonium molybdate and 70 ml of N,N'-diethyl-m-methylbenzoic acid amide, were added to a reactor and heated and stirred at 200° C. for 4 hours for reaction. After completion of the reaction, the mixture was cooled to 100° C., and 120 ml of N-methylpyrrolidone was added thereto, followed by stirring at 100° C. for 1 hour and then by filtration. The obtained reaction product was washed sequentially with N-methylpyrrolidone, water and methanol, followed by drying to obtain 12.1 g of $SnCl_2NPc$.

EXAMPLE 1

2 Parts of titanium oxide (particle size: 0.03 μm), 1 part of silica (particle size: 0.3 μm) and 0.007 part of $SnCl_2NPc$ prepared by the same method as in Preparation Example, were dispersed in a solvent mixture of methanol/n-propanol/toluene=5/2/3. The dispersion was added to a solution of 1 part of nylon (dissolved in a solvent mixture of methanol/n-propanol/toluene=5/2/3), followed by stirring for 30 minutes and then by ultrasonic wave treatment for 30 minutes. The coating fluid thus prepared was dip-coated on an aluminum base tube having a diameter of 60 mm and subjected to specular surface cutting so that Ry≦0.5 μm, followed by drying in air to obtain an undercoat layer having a thickness of 4 μm.

Then, 1.4 parts of a Y-type titanylphthalocyanine compound and 1.4 parts of a polyvinylbutyral resin (#6000C, manufactured by Denki Kagaku Kogyo K. K.) were subjected to dispersion and microsizing treatment by a sand grinder mill in 44 parts of methyl ethyl ketone and 15 parts of 4-methoxy-4-methylpentanone-2. The dispersion thus obtained was dip-coated to form a laminate on the undercoat layer, followed by drying in air to prepare a charge generation layer having a thickness of 0.55 μm.

Then, a solution having 70 parts by weight of an arylaminehydrazone compound of the following structural formula, 100 parts by weight of a polycarbonate Z resin dissolved in 600 parts by weight of tetrahydrofuran and 300 parts by weight of 1,4-dioxane, was dip-coated and then dried at 120° C. for 30 minutes to form a charge transport layer so that the thickness after drying would be 30 μm.

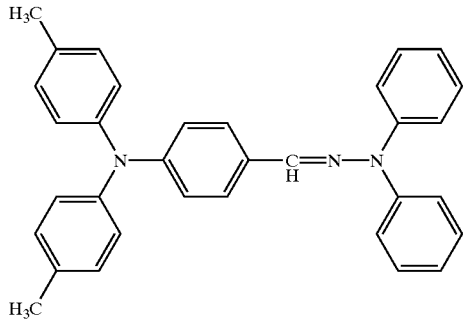

Evaluation Method

The reflectance was measured by a Spectro Multichannel Photodetector MC850A manufactured by Otsuka Electronics Co., Ltd. As the irradiated light, LED of 890 nm was used and irradiated at an angle of 50° to the coated surface, and the component reflected in a direction perpendicular to the coated surface, was detected by a photodiode, and the diffuse reflectance was measured.

Further, after electrification so that the initial surface potential would be −700 V as measured by an apparatus for evaluating the electrical properties of a photoreceptor, the surface potential VL after exposure with an exposure intensity of 0.1 $\mu J/cm^2$, was measured. Further, electrification and exposure were repeated 1,000 times, and VL was measured in the same manner. The results are shown in Table 1.

EXAMPLE 2

Using $SnCl_2NPc$ prepared in the same manner as in Preparation Example, a photoreceptor was prepared and evaluated in the same manner as in Example 1 except that the amount of $SnCl_2NPc$ in Example 1 was changed to 0.01 part. The results are shown in Table 1.

EXAMPLE 3

Using $SnCl_2NPc$ prepared by the same method as in Preparation Example, a photoreceptor was prepared and evaluated in the same manner as in Example 1 except that the amount of $SnCl_2NPc$ in Example 1 was changed to 0.1 part. The results are shown in Table 1.

EXAMPLE 4

Using $SnCl_2NPc$ prepared by the same method as in Preparation Example, a photoreceptor was prepared and evaluated in the same manner as in Example 1 except that the amount of $SnCl_2NPc$ in Example 1 was changed to 0.001 part. The results are shown in Table 1.

EXAMPLE 5

Using $SnCl_2NPc$ prepared by the same method as in Preparation Example, ten photoreceptors in Example 1 were prepared and evaluated. The results are shown in Table 2.

EXAMPLE 6

Using an aluminum base tube roughly cut to have a surface of Ry=0.5 μm instead of the aluminum base tube specular cut in Example 1 and using $SnCl_2NPc$ prepared in the same manner as in Preparation Example, ten photoreceptors were prepared and evaluated in the same manner as in Example 1 except that the amount of $SnCl_2NPc$ was changed to 0.03 part. The results are shown in Table 2.

EXAMPLE 7

Using an aluminum base tube roughly cut to have a surface of Ry=1.2 μm instead of the aluminum base tube specular cut in Example 1 and using $SnCl_2NPc$ prepared in the same manner as in Preparation Example, ten photoreceptors were prepared and evaluated in the same manner as in Example 1 except that the amount of $SnCl_2NPc$ was changed to 0.03 part. The results are shown in Table 2.

COMPARATIVE EXAMPLE 1

A photoreceptor was prepared and evaluated in the same manner as in Example 1 except that an infrared absorber SIR-130, manufactured by Mitsui Chemicals, Inc. was used instead of $SnCl_2NPc$ in Example 1. The results are shown in Table 1.

COMPARATIVE EXAMPLE 2

A photoreceptor was prepared and evaluated in the same manner as in Example 1 except that Fastogen Blue 8120BS, manufactured by Dainippon Ink and Chemicals, Incorporated, was used instead of $SnCl_2NPc$ in Example 1. The results are shown in Table 1.

COMPARATIVE EXAMPLE 3

A photoreceptor was prepared and evaluated in the same manner as in Example 1 except that $SnCl_2NPc$ in Example 1 was not added. The results are shown in Table 1.

TABLE 1

| | Diffuse reflectance | VL (V) | |
|---|---|---|---|
| | (%) | First time | 1,000 times |
| Example 1 | 50 | 66 | 68 |
| Example 2 | 37 | 68 | 69 |
| Example 3 | 23 | 69 | 70 |
| Example 4 | 69 | 65 | 68 |
| Comparative Example 1 | 50 | 156 | 271 |
| Comparative Example 2 | 80 | 66 | 339 |
| Comparative Example 3 | 80 | 65 | 68 |

TABLE 2

| Sample No. | Diffuse reflectance (%) in Example 5 | Diffuse reflectance (%) in Example 6 | Diffuse reflectance (%) in Example 7 |
|---|---|---|---|
| 1 | 50 | 35 | 40 |
| 2 | 49 | 36 | 45 |
| 3 | 48 | 38 | 46 |
| 4 | 49 | 33 | 37 |
| 5 | 50 | 34 | 35 |
| 6 | 51 | 35 | 36 |
| 7 | 50 | 33 | 34 |
| 8 | 48 | 36 | 41 |
| 9 | 50 | 37 | 47 |
| 10 | 51 | 34 | 46 |
| Average value | 50 | 35 | 41 |
| Minimum value | 48 | 33 | 34 |
| Maximum value | 51 | 38 | 47 |

EXAMPLE 8

Using $SnCl_2NPc$ prepared in the same manner as in Preparation Example, a photoreceptor was prepared in the same manner as in Example 1 except that an aluminum base tube having a diameter of 30 mm, a length of 254 mm and a wall thickness of 0.75 mm, specular cut to have a surface roughness of Ry≦0.5 μm. The obtained photoreceptor was incorporated in a laser printer Laser Jet4 plus, tradename, manufactured by Hewlett Packard, and images of dots of 20%, 50% and 75% were output, whereby in each image, no formation of interference fringes was observed.

COMPARATIVE EXAMPLE 4

A photoreceptor was prepared in the same manner as in Example 8 except that in Example 8 no $SnCl_2NPc$ was added, and the same images as in Example 8 were output, whereby in each image, formation of interference fringes was observed.

EXAMPLE 9

Using an aluminum base tube having a diameter of 140 mm, a length of 370 mm and a wall thickness of 3 mm, specular cut to have a surface roughness of Ry≦0.5 μm and using $SnCl_2NPc$ prepared in the same manner as in Preparation Example except that Y-type titanyl phthalocyanine was used as a charge generation material, a photoreceptor was prepared in the same manner as in Example 1. The obtained photoreceptor was incorporated in an apparatus prepared by modifying a tandem type color printer DCP32/D, manufactured by Xeikon Co. so that the reflectance of the photoreceptor can be measured under the same condition as in Example 1 immediately after development of each color of YMCK. A solid print of each color was output at a LED output corresponding to exposure (LDA) of 20% (corresponding to an exposure of 0.1 $\mu J/cm^2$), 30% (corresponding to an exposure of 0.14 $\mu J/cm^2$), 40% (corresponding to an exposure of 0.18 $\mu J/cm^2$) and 70% (corresponding to an exposure of 0.3 $\mu J/cm^2$) by fixing the development bias at −580 V when the output of the reflection center with the photoreceptor substrate was adjusted to be 1, whereby the reflection sensor output value of the toner image on the photoreceptor was measured. The results are shown in Table 3.

TABLE 3

| | K | | M | | C | | Y | |
|---|---|---|---|---|---|---|---|---|
| LDA (%) | Image density | Sensor output | Image density | Sensor output | Image density | Sensor output | Image density | Sensor output |
| 20 | 0.5 | 0.71 | 0.52 | 1.03 | 0.48 | 1.02 | 0.47 | 1.06 |
| 30 | 0.86 | 0.47 | 0.88 | 1.13 | 0.85 | 1.12 | 0.91 | 1.18 |
| 40 | 1.12 | 0.33 | 1.15 | 1.22 | 1.13 | 1.21 | 1.21 | 1.26 |
| 70 | 1.41 | 0.24 | 1.41 | 1.39 | 1.38 | 1.37 | 1.44 | 1.34 |

It is evident from Table 3 that the image density and the reflection sensor output have an adequate interrelation so that it is possible to carry out control of the image density based on the reflection sensor output.

COMPARATIVE EXAMPLE 5

A photoreceptor was prepared in the same manner as in Example 9 except that an aluminum base tube roughly cut to have a surface roughness of Ry=1.0 μm. The photoreceptor substrate, dots and solid print were output under the same conditions as the measurement in Example 9, whereby the photoreceptor reflection was measured. In this case, the diffuse reflection intensity of the photoreceptor substrate was 1.91 relative to the photoreceptor substrate in Example 9. The results are shown in Table 4.

TABLE 4

| | K | | M | | C | | Y | |
|---|---|---|---|---|---|---|---|---|
| LDA (%) | Image density | Sensor output | Image density | Sensor output | Image density | Sensor output | Image density | Sensor output |
| 20 | 0.48 | 1.33 | 0.53 | 1.96 | 0.49 | 1.95 | 0.48 | 1.96 |
| 30 | 0.87 | 0.82 | 0.9 | 2.21 | 0.87 | 2.19 | 0.93 | 2.21 |
| 40 | 1.1 | 0.68 | 1.18 | 2.31 | 1.15 | 2.25 | 1.24 | 2.32 |
| 70 | 1.4 | 0.64 | 1.41 | 2.35 | 1.4 | 2.31 | 1.41 | 2.35 |

It is evident from Table 4 that no distinct difference in the reflection sensor output value tends to be observed in a region where the image density is high, and it tends to be difficult to carry out the control of the image density based on the reflection sensor output value.

With the electrophotographic photoreceptor employing an undercoat layer of the present invention, it is possible to prevent interference fringes without impairing electrophotographic properties and to control the infrared reflectance of the photoreceptor, and it is also possible to improve the accuracy for detection by an optical density sensor.

While the invention has been described in detail and with reference to specific embodiments thereof, it will be apparent to one skilled in the art that various changes and modifications can be made therein without departing from the spirit and scope thereof.

This application is based on Japanese patent applications No. 2001-217681 filed on Jul. 18, 2001 the entire contents thereof being hereby incorporated by reference.

What is claimed is:

1. An electrophotographic photoreceptor having at least an undercoat layer and a photosensitive layer on an electroconductive substrate, wherein at least one layer of the undercoat layer contains at least one metal oxide dispersed in a resin and a naphthalocyanine compound of the following formula (1):

(1)

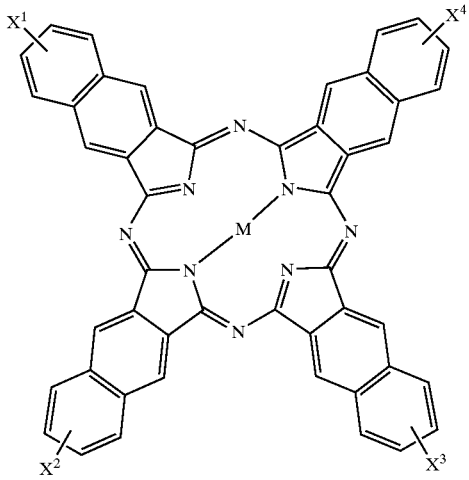

where, in the formula (1), M represents two hydrogen atoms, or a metal atom, provided that the metal atom may have a ligand, and each of $X^1$, $X^2$, $X^3$ and $X^4$ is a hydrogen atom or a substituent, wherein the photosensitive layer has a charge generation layer and a charge transport layer.

2. The electrophotographic photoreceptor according to claim 1, wherein the thickness of the undercoat layer containing the naphthalocyanine compound of the formula (1) is at most 10 $\mu$m.

3. The electrophotographic photoreceptor according to claim 1, wherein in the naphthalocyanine compound of the formula (1), each of $X^1$, $X^2$, $X^3$ and $X^4$ is a hydrogen atom.

4. The electrophotographic photoreceptor according to claim 1, wherein in the naphthalocyanine compound of the formula (1), M is a metal atom which may have a ligand.

5. The electrophotographic photoreceptor according to claim 4, wherein in the naphthalocyanine compound of the formula (1), M is a metal atom selected from the group consisting of Sn, Cu, Co, Ni, Fe, Zn, Ti, V, Al, Ga, In, Si, Ge and Pb.

6. The electrophotographic photoreceptor according to claim 1, wherein in the naphthalocyanine compound of the formula (1), M is a bivalent or higher valent metal atom which may have a ligand.

7. The electrophotographic photoreceptor according to claim 6, wherein in the naphthalocyanine compound of the formula (1), M is a metal atom which has an oxygen atom, a chlorine atom or a hydroxyl group as a ligand.

8. The electrophotographic photoreceptor according to claim 1, wherein in the naphthalocyanine compound of the formula (1), M is a metal atom which has a ligand selected from the group consisting of an oxygen atom, a sulfur atom, a halogen atom, a hydroxyl group, an alkoxy group or an alkylthio group.

9. The electrophotographic photoreceptor according to claim 1, wherein the charge generation layer contains an organic pigment as a charge generation material.

10. The electrophotographic photoreceptor according to claim 1, wherein the charge generation layer contains a phthalocyanine pigment and/or an azo pigment, as a charge generation material.

11. The electrophotographic photoreceptor according to claim 1, wherein the charge generation contains an oxytitanium phthalocyanine pigment as a charge generation material.

12. The electrophotographic photoreceptor according to claim 1, wherein the charge generation layer contains an oxytitanium phthalocyanine showing a diffraction peak at least at a Bragg angle ($2\theta \pm 0.2°$) of 27.3° in the X-ray diffraction spectrum using CuK$\alpha$ as a radiation source.

13. The electrophotographic photoreceptor according to claim 1, wherein the surface roughness of the electroconductive substrate is $Ry \leqq 1.0$ $\mu$m.

14. An electrophotographic apparatus comprising the electrophotographic photoreceptor as defined in claim 1, a charging means to charge the electrophotographic photoreceptor, an exposure means to carry out exposure of the charged electrophotographic photoreceptor to form an electrostatic latent image, a developing means to carry out development of the electrophotographic photoreceptor having the latent image formed, with a toner, and a transfer means to transfer a toner image formed on the electrophotographic photoreceptor onto a transfer material.

15. An electrophotographic apparatus comprising the electrophotographic photoreceptor as defined in claim 1, and a means to measure the density of the toner image on the electrophotographic photoreceptor by an optical density sensor comprising a light-emitting section for emitting light in a near infrared region and a light-receiving section.

16. The electrophotographic apparatus according to claim 15, wherein the optical density sensor is one to measure diffuse reflection light.

17. A method of making the electrophotographic photoreceptor according to claim 1, comprising coating said at least an undercoat layer and a photosensitive layer, in that order, on an electroconductive substrate, wherein said coating is by spray coating, spiral coating, ring coating, or dip coating, wherein said charge generation layer and said charge transport layer are coated in either order.

18. An electrophotographic photoreceptor having at least an undercoat layer and a photosensitive layer on an electroconductive substrate, wherein at least one layer of the undercoat layer contains at least one metal oxide dispersed in a resin, and a naphthalocyanine compound of the formula $SnCl_2NPc$ and wherein the photosensitive layer has a charge generation layer and a charge transport layer.

19. An electrophotographic photoreceptor having at least an undercoat layer and a photosensitive layer containing at least an organic pigment as a charge generation material on an electroconductive substrate, wherein at least one layer of the undercoat layer contains a naphthalocyanine compound of the following formula (1):

(1)

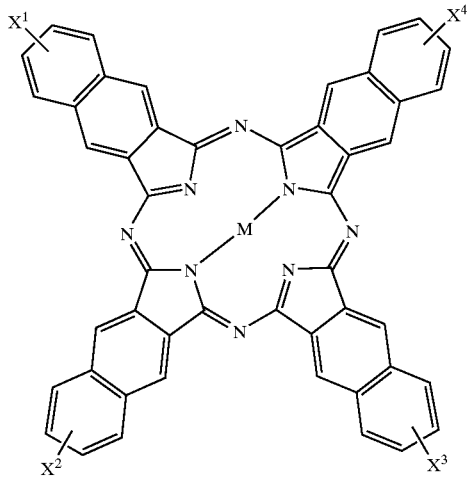

where, in the formula (1), M represents two hydrogen atoms, or a metal atom, provided that the metal atom may have a ligand, and each of X1, X2, X3 and X4 is a hydrogen atom or a substituent, and wherein the photosensitive layer comprises a charge transport layer on a charge generation layer.

* * * * *